United States Patent [19]

Hildreth

[11] 4,400,879

[45] Aug. 30, 1983

[54] HAIR SECTIONING TOOL

[76] Inventor: Michael S. Hildreth, 2206 Noble Oaks Dr., Savannah, Ga. 31406

[21] Appl. No.: 282,900

[22] Filed: Jul. 13, 1981

[51] Int. Cl.[3] ..... A45D 24/36

[52] U.S. Cl. ..... 132/151; 132/152

[58] Field of Search ..... 132/11 R, 88.5, 9, 45 R, 132/151, 152, 153, 119, 163, 112, 40; 66/4

[56] References Cited

U.S. PATENT DOCUMENTS

| | | | |
|---|---|---|---|
| 792,887 | 6/1905 | Erstling | 132/11 |
| 1,465,519 | 8/1923 | Howard | 132/11 |
| 2,382,614 | 8/1945 | De La Pena | 66/4 |
| 2,792,007 | 5/1957 | Parmer | 132/163 |
| 3,394,714 | 7/1968 | Kirwan | 132/11 |
| 4,230,134 | 10/1980 | Perez | 132/45 R |
| 4,294,270 | 10/1981 | Cochran | 132/112 |
| 4,327,754 | 5/1982 | Hildreth | 132/40 |

*Primary Examiner*—Richard J. Apley
*Assistant Examiner*—George Yanulis

[57] ABSTRACT

A sectioning tool for sectioning the hair on a person's head allows individual sections of hair to be easily, quickly and thoroughly treated with chemical solutions such as hair colors, tints or relaxers. The tool includes a base member having two substantially perpendicular legs, one of which is used to secure the tool in the hair next to the scalp. A plurality of finger means are individually movably mounted on the second leg from a first position where they divide the hair into a plurality of sections and to a second position so that the section of hair held between individual ones of the finger means is released for treatment.

24 Claims, 7 Drawing Figures

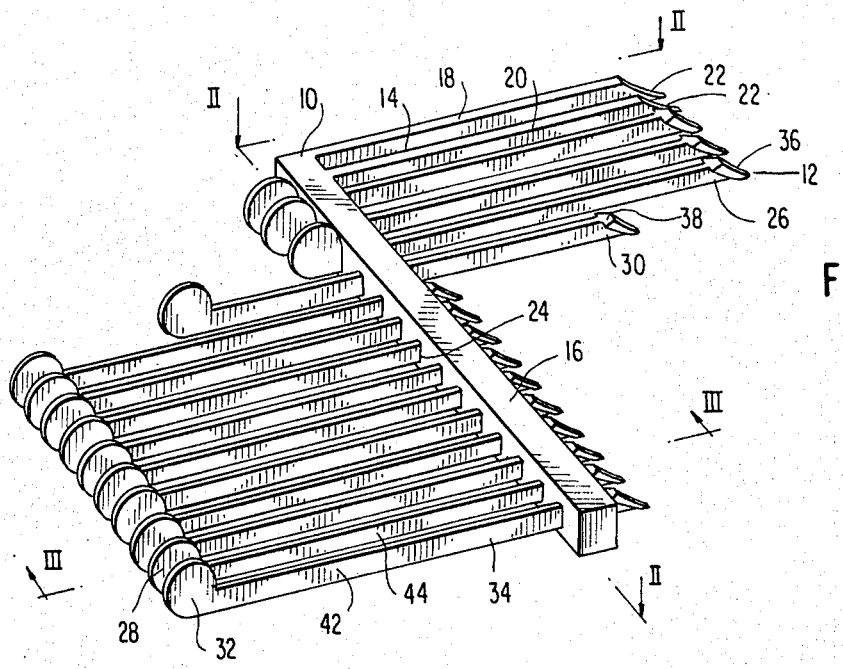
FIG. 1
FIG. 2
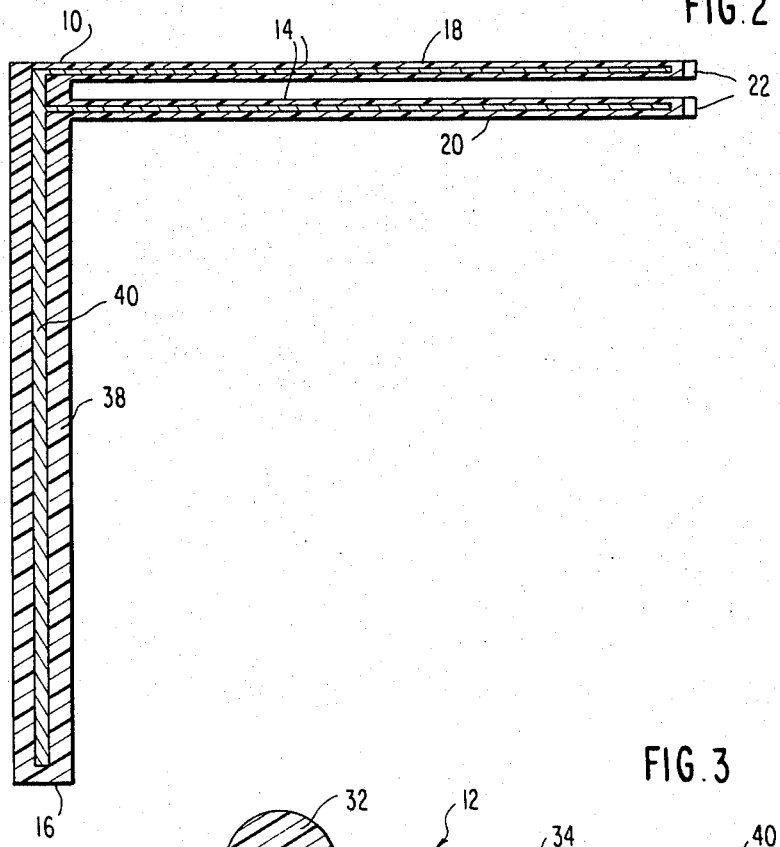
FIG. 3
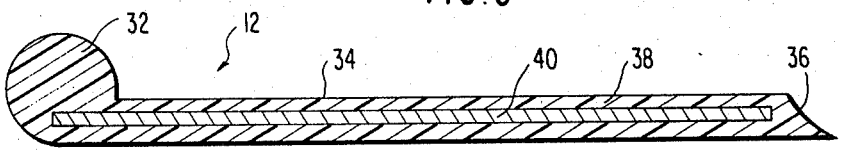

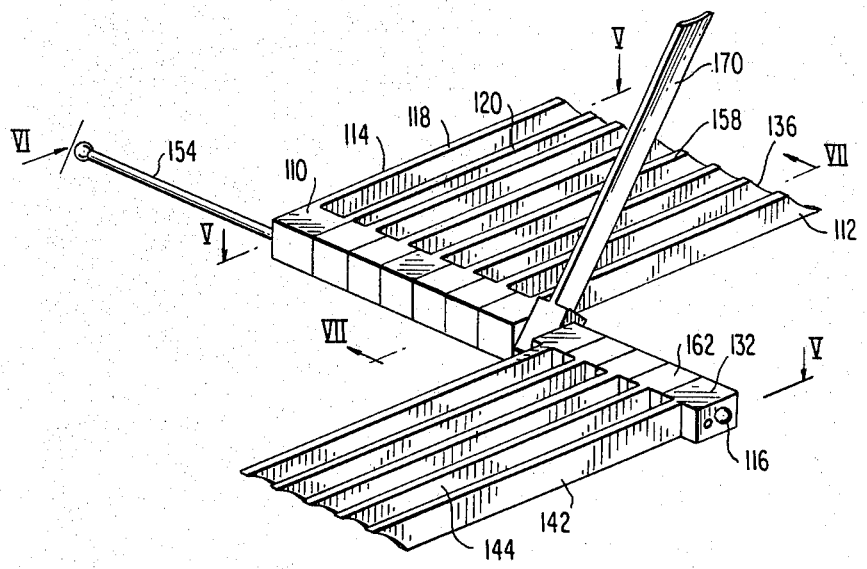
FIG. 4
FIG. 6
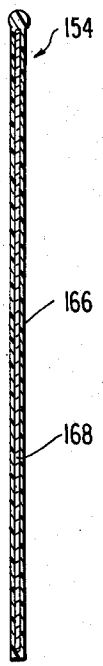
FIG. 5
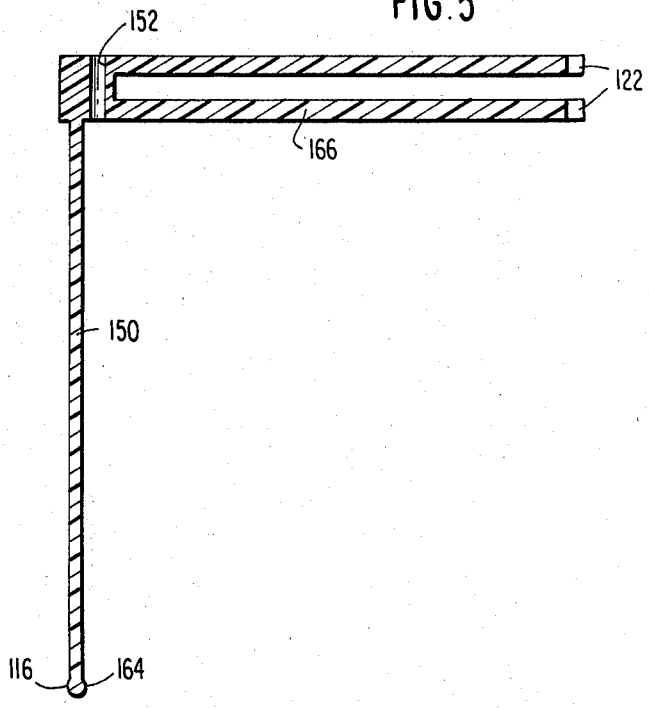
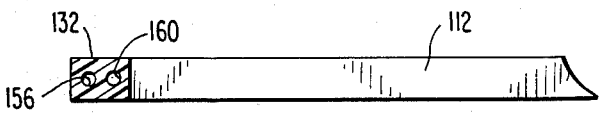
FIG. 7

HAIR SECTIONING TOOL

BACKGROUND OF THE INVENTION

When treating hair on a person's head with chemicals such as dyes, relaxers, setting lotions, and other chemicals to bring about desired results in the hair it is necessary that all portions of the hair to be treated are contacted by the chemical. In the past such treatments have been effected by manually isolating a particular section of the hair on the person's head and treating that section with the chemical. Then a second section is manually isolated and treated, and so on until the entire head of hair has been treated.

This manual method of hair treatment has certain disadvantages. It takes great care to be sure that all areas are treated, since the treated and untreated areas are not always readily distinguishable. If areas are missed, the result is a blotchy effect. In order to avoid the blotchy effect, great care has been necessitated to be sure that all areas are adequately covered, requiring inordinate amounts of time. Additionally, many chemical treatments are to remain on the hair for a certain period of time and then be washed out. In the manual method, the sections treated early are sometimes ready to be washed out before the entire head has been treated. This, of course, raises many problems for the hairdresser.

Also, when treating hair with chemicals, particularly when coloring the hair, it is necessary to be sure that the chemicals reach the hair roots at the scalp. In the manual sectioning method, it is difficult to cause the chemicals to penetrate all the way to the roots, particularly if too large a section of hair is being treated at any given time.

It is known from U.S. Pat. No. 3,394,714 to Kirwan to use a hair gathering device in which a comb has two spaced-apart sets of teeth and a gauge member transversely mountable on the teeth to be used to isolate sections of hair in order to wrap the hair around a roller or curler. The device, however, does not section the hair at the scalp line, which is necessary in order to properly section the hair for application of hair coloring and other treating chemicals. Furthermore, the Kirwan device does not provide enough hair sections of suitable size for use in applying chemicals.

The present invention contemplates a sectioning device in which a plurality of finger members are arranged in a comb-like pattern and are individually movable out of the way, one at a time in order to expose sections of hair between the finger members for chemical treatment. It is known from U.S. Pat. No. 792,887 to Erstling and U.S. Pat. No. 1,465,519 to Howard to provide combs in which the teeth are engageable together, and pivotable with respect to one another in order to provide access to the inside faces of the teeth for easy cleaning. These patents, however, do not teach the art how to make or use movable finger members in order to section the hair for chemical treatments.

Accordingly there is a need in the art for a hair sectioning tool which will divide the hair on a person's head into sections at the scalp line and which is then manipulable to expose the sections one by one to the hairdresser for chemical treatment of all the hair in the section.

SUMMARY OF THE INVENTION

The present invention fulfills this need in the art by providing a hair sectioning tool to divide the hair on a person's head into a plurality of sections to facilitate the manipulation thereof in which the tool has a base member having first and second substantially perpendicular legs, the first leg having means to engage a portion of the hair to retain the base member in a desired position on the head, and a plurality of finger means individually movably mounted on the second leg of the base member for movement between a first position in which the finger means are side by side one another to a second position in which the finger means are not side by side the fingers in the first position.

In a preferred embodiment the second leg of the base member has a plurality of spaced-apart apertures for slidably receiving the finger means so that the finger means can be slidably retracted from the first position to the second position. In this embodiment the finger means have a first end, a mid portion, and a second end, with the mid portion being of a cross section slightly smaller than the cross section of the apertures in the second leg of the base member to allow slidable retraction of the finger means. The first end of the finger means includes a handle larger in cross section than the aperture to prevent sliding movement of the first end through the aperture. The second end of the finger means is tapered to provide ease of insertion of the tool into the hair. Preferably the second end is also provided with a thickened portion decreasing in cross section toward the second end facilitating the insertion of the finger means into the apertures in the second leg of the base member but inhibiting their removal.

In another embodiment the second leg of the base member takes the form of a cylindrical rod and each of the finger means has a first end provided with a transverse aperture for receiving the cylindrical rod so that each of the finger means can be pivoted about the cylindrical rod from the first position to the second position. The first end of each of the finger means have a second transverse aperture substantially parallel to the first aperture and the first leg of the base member has an aperture colinear with each of the second transverse apertures of the finger means when the finger means are in the first position, for removably receiving an independent rod whereby each of the finger means cannot be pivoted about the cylindrical rod and are retained in the first position when the independent rod is inserted in the second apertures in the finger means and the aperture in the first leg of the base member. In each of the finger means the first end of the finger means is of a larger dimension in the direction of the cylindrical rod than the remainder of the finger means to provide spacing between adjacent ones of the remainders of the finger means. In this embodiment, like the first, each of the finger means has a second end tapered to provide ease of insertion of the tool into the hair. The cylindrical rod has one end connected to the first leg of the base member and a second end has means for retaining the finger means on the cylindrical rod.

In either embodiment, the invention can be made of a plastics material inert to hair treating chemicals. Preferably, bendable metallic shape-retaining reinforcements are encased by the plastics material.

BRIEF DESCRIPTION OF THE DRAWINGS

The invention will be better understood by a reading of the following detailed description along with a study of the drawings in which:

FIG. 1 is a perspective view of a preferred embodiment of the invention;

FIG. 2 is a sectional view of the base member taken along lines II—II in FIG. 1;

FIG. 3 is a sectional view of one of the finger means taken along lines III—III in FIG. 1;

FIG. 4 is a perspective view of a second embodiment;

FIG. 5 is a sectional view of the base member of the second embodiment taken along lines V—V of FIG. 4;

FIG. 6 is a sectional view of the independent rod taken along line VI of FIG. 4;

FIG. 7 is an elevational and partly sectional view of the finger means of the second embodiment taken along lines VII—VII of FIG. 4.

DETAILED DESCRIPTION OF THE DRAWINGS

Referring to FIG. 1, the hair sectioning tool includes a base member 10 and a plurality of fingers 12. Preferably the number of fingers 12 is twelve.

The base member 10 includes a first leg 14 and a second leg 16 which are substantially perpendicular to one another. The first leg 14 includes two tooth-like members 18 and 20 which have ends 22 shaped with a taper so that when the entire assembled device is inserted into the hair it will be easily movable toward the scalp. The two tooth-like members 18 and 20 engage a section of hair therebetween to hold the base member in place even when all of the fingers have been retracted, as will be described later.

The second leg 16 is a substantially solid member but has a plurality of apertures 24 therethrough, oriented generally parallel to tooth-like members 18 and 20. The number of apertures 24 preferably equals the number of fingers 12 provided.

Fingers 12 are mounted in apertures 24 as shown, having a first position such as shown by finger 26 in which the fingers are side by side one another and a second position as shown by finger 28 in which the fingers are not side by side the fingers in the first position. Finger 30 shows one of the fingers moving from the first position to the second position.

The fingers 12 have handles 32 on one end so that the fingers can be retracted from the first position to the second position easily by a hair dresser. Handles 32 also prevent the fingers from moving all the way through the apertures 24 to the right, as seen in FIG. 1. The fingers also have mid portions 34 having a cross section slightly smaller than the cross section of aperture 24, so that the fingers 12 slide between the first and second positions when the hair dresser manipulates the handle 32.

Like the tooth-like members 18 and 20, the fingers are provided with tapered second ends 36 to provide easy insertion of the tool into the hair, next to the scalp.

Viewed from the top, the second end of the fingers have a trapezoidally shaped portion 38, with a cross section greater than the cross section of the apertures 24 but decreasing in cross section toward the second end. This structure facilitates the insertion of the fingers 12 into the apertures 24, but inhibits their removal.

By employing this construction, the base member and fingers can be molded separately and sold together as a kit so that the customer can assemble the fingers into the base section easily, but without fear of the fingers becoming detached from the base section when in use or storage.

As seen in FIG. 2, a sectional view taken along the lines II—II in FIG. 1, below the level of apertures 24, the base member is made of a plastic material 38 selected so as to be inert to any chemicals such as hair coloring, dyes, tints, hair relaxers, setting lotions or other chemicals with which the apparatus may come in contact.

Preferably the apparatus is reinforced with a bendable metallic shape-retaining reinforcement 40 to add sufficient rigidity to the apparatus to hold its shape when used. However, it will be understood that the relatively planar apparatus as seen in FIG. 1 can be bent to approximate the curvature of the scalp of the person whose hair is being treated. The metallic reinforcements will then retain the curved shape.

As seen in FIG. 3, the fingers 12 are also made of a metallic reinforcement 40 encased by plastics material 38, substantially the same as base member 10.

When the apparatus is to be used, all of the fingers are moved to the first position, as shown by finger 26 and the apparatus is inserted into the hair near the scalp, with the hair being divided into sections between adjacent ones of fingers 12. Since the apparatus is inserted and placed next to the scalp the hair is sectioned all the way to the scalp. If desired, when treating areas on the head near the ear or other area having non-uniform shapes, certain ones of legs 12 can initially be retracted out of the way into the second position as shown by finger 28 to provide a sectioning tool of smaller effective size.

Assuming that all of the fingers 12 are being used to section, first finger 42 is moved from the first position to the second position, thereby releasing the section of hair between fingers 42 and 44 to allow treatment of that section of hair. This section can then be allowed to drop out of the way, and finger 44 can be moved from the first position to the second position, releasing the next section of hair for treatment, and so on through all of the fingers 12.

When all of the sections between the fingers 12 have been treated, the apparatus is removed from the hair and the fingers are moved back to the first position and reinserted in a new area on the head and the process is repeated.

Although the apparatus can be made of any size, a preferred size has the first leg 14 of base member 10 three inches long and the fingers 12 spaced three-eighths inch apart.

In the second embodiment, shown in FIGS. 4–7, the base member 110 has a first leg 114 and a second leg 116 substantially perpendicular to first leg 114. Secondly leg 116 has a first end connected to first leg 114. First leg 114 includes tooth-like members 118 and 120 substantially similar to tooth-like members 18 and 20 of the first embodiment. The second leg 116 comprises a cylindrical rod 150, seen in section in FIG. 5. Also as seen in FIG. 5, the first leg 114 is provided with aperture 152 substantially parallel with rod 150. Independent rod 154 (FIGS. 4 and 6) has a cross sectional size slightly smaller than aperture 152 so as to be appropriate to be inserted therein.

Each of fingers 112 has a first end 132 provided with a transverse aperture 156 so that fingers 112 can be pivotably mounted on cylindrical rod 150. A second aperture 160 is provided in each finger substantially parallel to aperture 150 and of the same size as aperture 152. When so mounted, and arranged in the first position with the fingers side by side one another, as finger 158 of FIG. 4, apertures 160 in first ends 132 of fingers 112 align with aperture 152 of the base member so that independent rod 154 can be passed through all of apertures 160 of the fingers 112 and aperture 152. The presence of independent rod 154, of course, prevents the pivoting motion of fingers 112 out of the first position shown by finger 158. When independent rod 154 is retracted, as shown in FIG. 4, the fingers 112 can pivot about cylindrical rod 150 to the second position shown by fingers 142 and 144 in FIG. 4. Finger 170 of FIG. 4 represents a finger moving from the first position to the second position.

As will be apparent from FIG. 4, each first end 132 of finger 112 is provided with a head 162 of larger dimension in the direction of the cylindrical rod 150 than the remainder of the finger 112, to provide spacing between adjacent ones of the remainders of the fingers. The second ends 136 of fingers 112 are tapered to provide ease of insertion of the tool into the hair, next to the scalp. It will be noted from FIG. 5 that the cylindrical rod 150 has a second end 164 provided with a bulb which retains the fingers on the cylindrical rod.

As in the first embodiment, the apparatus can be made of any suitable plastics material 166 encasing the shape-retaining metallic reinforcement 168.

The tooth-like members 118 and 120 of base member 110 are provided with tapered ends 122 of similar shape to tapered ends 136 of fingers 112.

The operation of the second embodiment is straightforward. Firstly, the fingers 112 are arranged in the first position such as shown by finger 158 and independent rod 154 is inserted through all of their apertures 160, thus preventing movement out of the first position. The apparatus is inserted into the hair at the desired location, thereby sectioning the hair between adjacent ones of fingers 112. The independent rod 154 is retracted out of finger 142 only to allow finger 142 to be pivoted to the second position such as shown in FIG. 4. The section of hair held between fingers 142 and 144 is thereby released and can be treated with the desired chemicals. Then independent rod 154 is further retracted, and finger 144 is pivoted about cylindrical rod 150 and the next section of hair is released for treatment. The process continues until all of the sections between the fingers 112 have been treated and the apparatus is reassembled and reinserted in an adjacent portion of the hair.

The second embodiment can be sized comparably to the first embodiment, although I intend no limitation on size.

Any number of fingers 12 and 112 can be used, although twelve is the preferred number. As with the first embodiment, the second can be altered to conform to the shape of the scalp because of bendable metallic shape-retaining reinforcements encased by the plastics material of the apparatus.

Various modifications to both embodiments can be made. For instance, the first legs 14 and 114 need not take the form of comb-like teeth, but could alternatively be clips or clamps of various designs, suitable to be affixed to the hair to hold the apparatus in position next to the scalp.

It will be understood that the apparatus is not limited to use with chemicals but can be used in any situation in which the sectioning of hair is desired, such as the rolling or curling of sections of hair.

I claim:

1. A hair sectioning tool to divide the hair on a person's head into a plurality of sections to facilitate the manipulation thereof comprising a base member having first and second substantially perpendicular legs, said first leg having means to engage a portion of said hair to retain said base member in a desired position on said head, and a plurality of finger means individually movably mounted on said second leg of said base member for movement between a first position in which said finger means are side-by-side one another to a second position in which said finger means are not side-by-side fingers in said first position.

2. A hair sectioning tool as claimed in claim 1 in which said second leg of said base member has a plurality of spaced-apart apertures for slidably receiving said finger means, whereby said finger means can be slidably retracted from said first position to said second position.

3. A hair sectioning tool as claimed in claim 2 in which each of said finger means has a first end, a midportion, and a second end, said midportion being of a cross section slightly smaller than the cross section of said aperture in said second leg of said base member to allow slidable retraction, said first end comprising a handle larger in cross section than said aperture to prevent sliding movement of said first end through said aperture.

4. A hair sectioning tool as claimed in claim 3 in which said second end of said finger means is tapered to provide ease of insertion of said tool into said hair.

5. A hair sectioning tool as claimed in either claim 3 or 4 in which said second end is provided with a portion having a cross section greater than the cross section of said apertures in said second leg of said base member decreasing in cross section toward said second end facilitating the insertion of said finger means into said aperture in said second leg of said base member but inhibiting its removal.

6. A hair sectioning tool as claimed in claim 1 wherein said second leg of said base member comprises a cylindrical rod and wherein each of said finger means has a first end provided with a first transverse aperture for receiving said cylindrical rod whereby said finger means can be pivoted about said cylindrical rod from said first position to said second position.

7. A hair sectioning tool as claimed in claim 6 wherein each of said first ends of said finger means has a second transverse aperture substantially parallel to said first aperture and said first leg of said base member has an aperture colinear with each of said second transverse apertures when said finger means are in said first position for removably receiving an independent rod whereby when said independent rod is inserted in said second apertures and said aperture in said first leg of said base member said finger means cannot be pivoted about said cylindrical rod and are retained in said first position.

8. A hair sectioning tool as claimed in either claim 6 or 7 wherein in each of said finger means, said first end of said finger means is of larger dimension in the direction of said cylindrical rod than the remainder of said finger means to provide spacing between adjacent ones of said remainders of said finger means.

9. A hair sectioning tool as claimed in either claim 6 or 7 in which said finger means has a second end tapered to provide ease of insertion of said tool into said hair.

10. A hair sectioning tool as claimed in claim 7 wherein said cylindrical rod has a first end connected to said first leg of said base member and a second end having means for retaining said finger means on said cylindrical rod.

11. A hair sectioning tool as claimed in any of claims 1, 2, 3, 4, 6 or 7 made of a plastics material inert to hair treating chemicals.

12. A hair sectioning tool as claimed in claim 11 further comprising bendable metallic shape-retaining reinforcements encased by said plastics material.

13. A hair sectioning tool for dividing the hair of a persons head into a plurality of segments to facilitate the manipulation of the hair comprising an elongated base member having holding means for engagement of a hair portion for maintaining said hair sectioning tool in a given position on the persons head, a plurality of elongated fingers and mounting means for movably supporting said fingers on said elongated base member at a first position of substantially coplanar parallel alignment and extension of said fingers to one another to one side of said base member to divide the persons hair into a plurality of segments and for selective individual movement of said fingers out of the coplanar parallel alignment and extension of the first position thereof to a second position with at least the main length thereof extending to another side of said base member to selectively expose the hair segment between given ones of said fingers for manipulation thereof.

14. A hair sectioning tool as claimed in claim 13 in which said mounting means for movably supporting said fingers comprises a leg of said base member having a plurality of spaced-apart apertures for slidably receiving said fingers, whereby said fingers can be slidably retracted from said first position to said second position.

15. A hair sectioning tool as claimed in claim 14 in which each of said fingers has a first end, a midportion, and a second end, said midportion being of a cross section slightly smaller than the cross section of said aperture in said leg of said base member to allow slidable retraction, said first end comprising a handle larger in cross section than said aperture to prevent sliding movement of said first end through said aperture.

16. A hair sectioning tool as claimed in claim 15 in which said second ends of said fingers are tapered to provide ease of insertion of said tool into said hair.

17. A hair sectioning tool as claimed in either claim 15 or 16 in which said second ends are provided with portions having a cross section greater than the cross section of said apertures in said leg of said base member decreasing in cross section toward said second end, facilitating the insertion of said fingers into said apertures in said leg of said base member but inhibiting their removal.

18. A hair sectioning tool as claimed in claim 13 wherein said base member comprises a cylindrical rod and wherein each of said fingers has a first end provided with a first transverse aperture for receiving said cylindrical rod whereby said fingers can be pivoted about said cylindrical rod from said first position to said second position.

19. A hair sectioning tool as claimed in claim 18 wherein each of said first ends of said fingers has a second transverse aperture substantially parallel to said first aperture and said base member has an aperture colinear with each of said second transverse apertures when said fingers are in said first position for removably receiving an independent rod, whereby when said independent rod is inserted in said second apertures and said aperture in said base member said fingers cannot be pivoted about said cylindrical rod and are retained in said first position.

20. A hair sectioning tool as claimed in either claim 18 or 19 wherein in each of said fingers, said first end of said finger is of larger dimension in the direction of said cylindrical rod than the remainder of said finger to provide spacing between adjacent ones of said remainders of said fingers.

21. A hair sectioning tool as claimed in either claim 18 or 19 in which each said finger has a second end tapered to provide ease of insertion of said tool into the hair.

22. A hair sectioning tool as claimed in claim 19 wherein said cylindrical rod has a first end connected to said base member and a second end having means for retaining said fingers on said cylindrical rod.

23. A hair sectioning tool as claimed in any of claims 13, 14, 15, 16, 18 or 19 made of a plastics material inert to hair treating chemicals.

24. A hair sectioning tool as claimed in claim 23 further comprising bendable metallic shape-retaining reinforcements encased by said plastics material.

* * * * *